US007595465B2

(12) United States Patent
Kolk

(10) Patent No.: US 7,595,465 B2
(45) Date of Patent: Sep. 29, 2009

(54) DEVICE FOR KEEPING HEATING WIRES IN POSITION IN A HORIZONTAL OVEN

(75) Inventor: Barteld Kolk, Hoogeveen (NL)

(73) Assignee: Tempress Systems, Inc., Heerde (NL)

( * ) Notice: Subject to any disclaimer, the term of this patent is extended or adjusted under 35 U.S.C. 154(b) by 654 days.

(21) Appl. No.: 11/333,120

(22) Filed: Jan. 17, 2006

(65) Prior Publication Data

US 2006/0196866 A1 Sep. 7, 2006

(30) Foreign Application Priority Data

Jan. 18, 2005 (NL) ..... 1028057

(51) Int. Cl.
*F27B 5/14* (2006.01)
*F27D 11/00* (2006.01)

(52) U.S. Cl. ..... 219/402; 219/411; 219/537; 373/128; 174/150; 174/172

(58) Field of Classification Search ..... None
See application file for complete search history.

(56) References Cited

U.S. PATENT DOCUMENTS 1,430,861 A * 10/1922 Tang ..... 373/130
1,698,282 A * 1/1929 Simmons ..... 174/138 J
2,035,306 A * 3/1936 Fannin ..... 373/130
D258,877 S * 4/1981 King ..... D13/131
4,531,017 A * 7/1985 Sherrill ..... 174/138 J
4,553,246 A * 11/1985 Christie ..... 373/130
5,095,192 A * 3/1992 McEntire et al. ..... 219/402
5,187,771 A * 2/1993 Uchida ..... 392/416
5,506,389 A * 4/1996 Hidano et al. ..... 219/390
6,376,814 B2 * 4/2002 Holmes ..... 219/536

* cited by examiner

*Primary Examiner*—Joseph M Pelham
(74) *Attorney, Agent, or Firm*—Hoffmann & Baron, LLP

(57) ABSTRACT

Device for keeping a heating wire (2) in position in a horizontal oven includes a ceramic bar (3) and a number of ceramic spacer elements (4). Each spacer element consists of a bar-shaped part, on which a Y-shaped part (6) is placed near the center of the bar-shaped part. The V-shaped part of the Y-shaped part can partially enclose the bar. Near one end, the bar-shaped part is preferably provided with a transverse part, which is at right angles to the bar-shaped part and runs parallel to the Y-shaped part, so that a U-shaped recess is created which can accommodate the heating wire and the other side of the Y-shaped part and the bar-shaped part together form an L-shaped recess in which the heating wire can also be accommodated. The one end of each spacer element is provided with a projection and the other end with a recess.

6 Claims, 2 Drawing Sheets

DEVICE FOR KEEPING HEATING WIRES IN POSITION IN A HORIZONTAL OVEN

CROSS-REFERENCE TO RELATED APPLICATIONS

This application claims the benefit of Netherlands Application No. NL 1028057, filed Jan. 18, 2005, the contents of which is incorporated herein by reference.

FIELD OF THE INVENTION

The invention relates to a device for keeping heating wires in position in an oven, and more particularly in a horizontal oven.

BACKGROUND OF THE INVENTION

In an electric oven, heating or incandescent wires are used in order to be able to heat the interior of the oven. The heating wires are made from a metal which is able to conduct electricity well and can be heated to the desired high temperatures without the material deforming. The heating wires have to be kept a certain distance apart so that the temperature of the oven can be kept as even as possible throughout. To this end, the heating wires are kept apart by means of spacer pieces or spacer strips. However, the hotter the heating wires become, the softer the material from which the heating wires are made will become. In a horizontal oven, where the heating wires are arranged in a helical or meandering fashion, i.e., run more or less to and fro, the heating wires will become softer as the temperature increases and, beyond a certain temperature, the risk that the wires will sag under their own weight and by the effect of gravity will increase. As a result, not only will the oven not be heated as evenly throughout as desired, but also the sagging heating wires can come into contact with materials which are in the oven. The heating wires in a horizontal oven will therefore have to be supported, especially if the wires are located at the top of the oven, so that the wires no longer sag when, due to the heating of the wires, the material from which they are made becomes so soft that they start to sag as a result of their own weight. However, care should also be taken to ensure that the heating wires are not clamped in, as the wires expand on heating and need a sufficient degree of freedom of movement as there is otherwise a great risk of the wires snapping. This is of particular importance with horizontal ovens in which semiconductor materials are treated, as the treatment in these ovens is effected at high temperatures, which may cause the heating wires which have become too soft to sag.

SUMMARY OF THE INVENTION

It is an object of the invention to provide a device with which it is possible to arrange a heating wire in a horizontal oven in such a way that the heating wire is locked in, in such a manner that it stays in place without the wire being clamped in. An additional object is that by applying the device according to the invention, the heating wires can be installed easily and can preferably be mounted in stages, ring by ring, thereby enabling a time saving.

This object is achieved by a device according to the invention, in that the device consists of a bar and a number of spacer elements, each spacer element consisting of a bar-shaped part, on which a Y-shaped part is placed near the centre of the bar-shaped part, the bar-shaped part being at right angles to the plane through the Y-shaped part, and in that the V-shaped part of the Y-shaped part can partially enclose the bar, so that the spacer element is T-shaped in cross section through the bar-shaped part and the longitudinal axis of the Y-shaped part.

The result of these measures is that when a heating wire is fitted in an oven, the heating wire can be fitted in the oven in stages, winding by winding, in the oven while, when the heating wire has been fitted in an oven using this device, the heating wire does not have the tendency to sag by the effect of gravity when the heating wire softens as a result of an increase in the temperature. As the heating wire according to the invention is entirely enclosed by the device at a suspension point without the heating wire being clamped in, there is sufficient space around the heating wire for it to expand by the effect of the heat, yet the heating wire will roughly stay in place, as a result of which it is possible to achieve a good, even heat distribution in the oven at every temperature.

In one preferred embodiment of the device according to the invention, at one end of the bar-shaped part, each spacer element is provided with a transverse part which is at right angles to the bar-shaped part and runs parallel to the Y-shaped part, creating a U-shaped recess in which the heating wire can be accommodated, and the other side of the Y-shaped part and the bar-shaped part together form an L-shaped recess in which the heating wire can also be accommodated and the bar-shaped part and the spacer elements are made of ceramic material, while the one end of the bar-shaped part of a spacer element is provided with a projection in line with the bar-shaped part and a recess is provided in the other end of the bar-shaped part, so that the projection of the one spacer element can interact with the recess which is provided in the other end of the bar-shaped part of the spacer element placed against it. The result of these measures is that when a number of spacer elements according to the invention are arranged on a ceramic bar, the spacer elements together form a strong unit. Thus, once a number of spacer elements have been fitted to a ceramic bar, there is a connection between the successive spacer elements. The ceramic bar may either be solid or recess. The use of a recess bar will result in a weight-saving.

BRIEF DESCRIPTION OF THE DRAWINGS

The invention will be explained in more detail with reference to the drawing, in which.

DETAILED DESCRIPTION OF PREFERRED EMBODIMENTS

Figure 1:
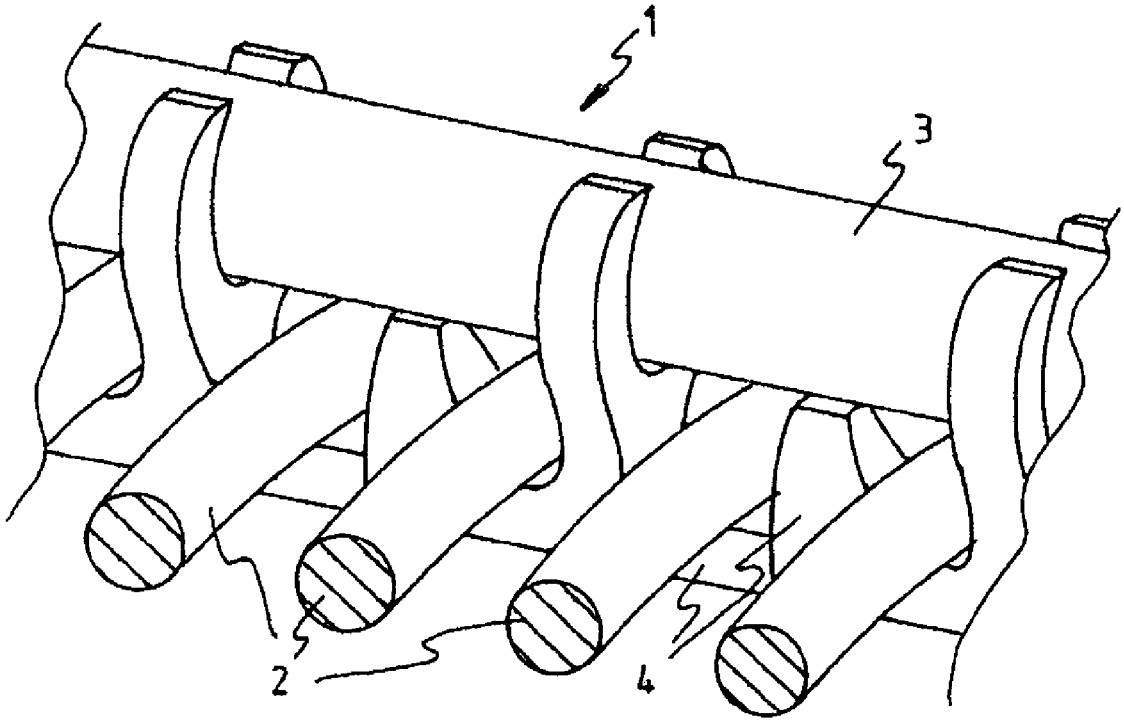
FIG. 1 shows a view of a part of the heating wires of a horizontal oven suspended using a device according to the invention.

FIG. 1 shows a part of a device 1 according to the invention with sections of a heating wire 2. The device consists of a ceramic bar 3 and a number of ceramic spacer elements 4, the sections of the heating bar 2 being enclosed between the ceramic spacer elements 4 and the ceramic bar 3.

Figure 2:
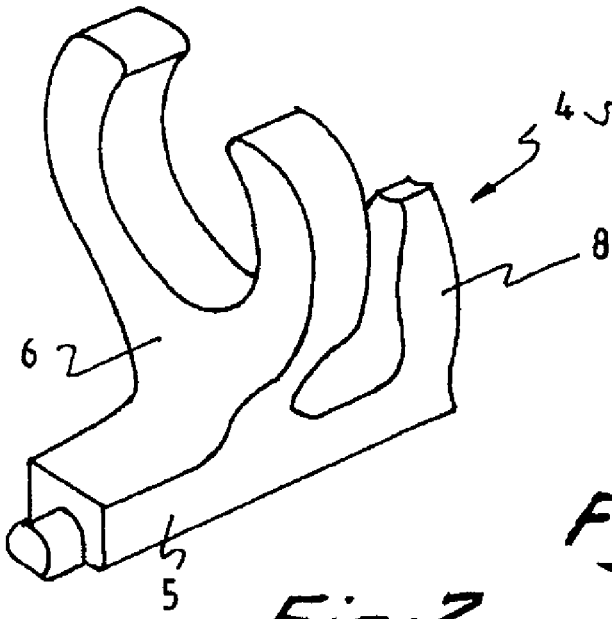
FIG. 2 shows a perspective view of a spacer element according to the invention.

FIG. 2 shows a view of a spacer element 4 according to the invention. Each spacer element 4 consists of a bar-shaped part 5, on which a Y-shaped part 6 is placed near the centre of the bar-shaped part 5. The bar-shaped part 5 is at right angles to the plane through the Y-shaped part 6.

Figure 3:
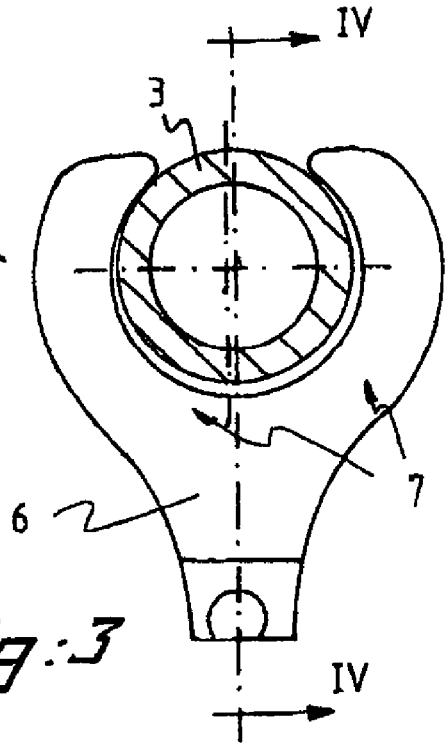
FIG. 3 shows a view of a spacer element from FIG. 4.
Figure 4:
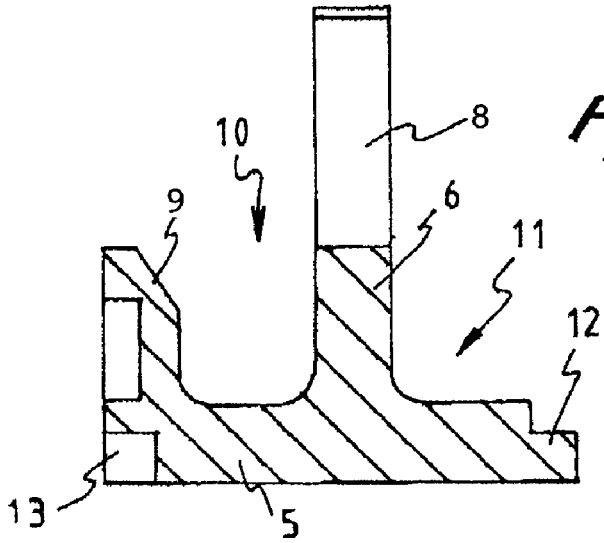
FIG. 4 shows a cross section through a spacer element according to the invention as illustrated in FIG. 2 along line IV-IV from FIG. 3.

FIG. 3 shows a view of the spacer element 4 from FIG. 4. The opening 7 delimited by the V-shaped part 8 of the Y-shaped part 6 is O-shaped, so that the V-shaped part 8 can partially enclose the ceramic bar 3, which ceramic bar 3 is preferably cylindrical.

FIG. 4 shows a cross section of a spacer element 4 according to the invention as illustrated in FIG. 2 along line IV-IV from FIG. 3. Near one end, the bar-shaped part 5 is provided with a transverse part 9, which is at right angles to the bar-shaped part 5 and runs parallel to the Y-shaped part 6, so that a U-shaped recess 10 is created which can accommodate the heating wire 2. On the other side of the Y-shaped part 6 and the bar-shaped part 5, an L-shaped recess 11 is created, in which the heating wire 2 can likewise be accommodated. Both the dimensions of the space delimited on one side by the ceramic bar 3 and on the other side by the U-shaped recess 10 of a spacer element 4, and the dimensions of the space delimited on one side by the ceramic bar 3 and on the other side by the L-shaped recess 11 of a spacer element 4 and the transverse part 9 of the adjoining spacer element are chosen such that a heating wire or incandescent wire 2 has sufficient space to be able to thermally expand. The one end of the bar-shaped part 5 of the spacer element 4 is provided with a projection 12 in line with the bar-shaped part 5 and a recess 13 is provided in the other end of the bar-shaped part 5, so that the projection of the one spacer element can interact with the recess which is provided in the other end of the bar-shaped part of the spacer element placed against it. The length of the transverse part 9 corresponds to the length of the stem of the Y-shaped part, as a result of which the transverse part 9 can rest roughly on the ceramic bar 3 when a spacer element is fitted to a ceramic bar.

Figure 5:
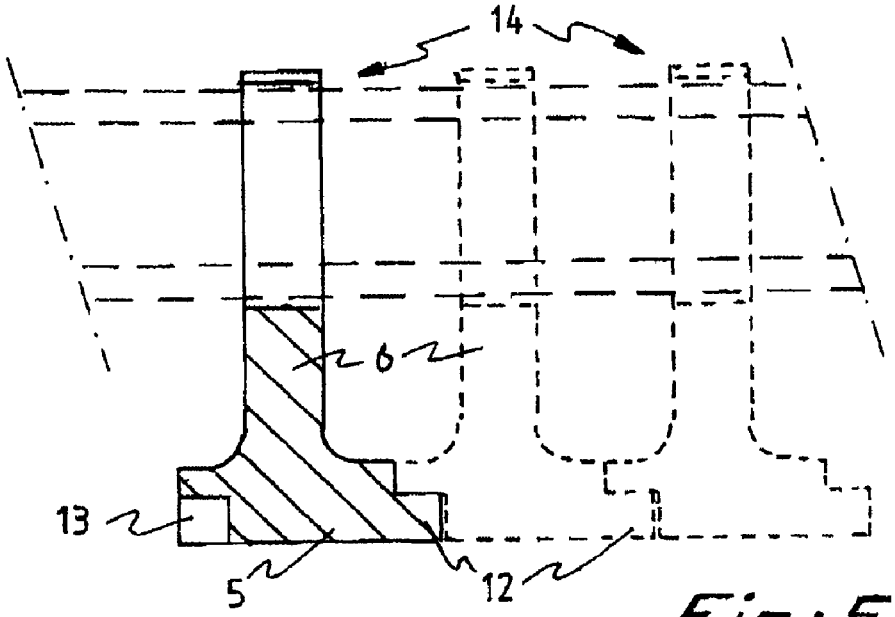
FIG. 5 shows a cross section of another possible embodiment of a spacer element according to the invention with a ceramic bar and another two spacer elements shown by dashed lines.

FIG. 5 shows another possible embodiment of a spacer element 14 according to the invention with, in dashed lines, two spacer elements 14 and a ceramic bar 3, onto which the spacer elements have been pushed. In this case, the spacer element 14 is also made up of a bar-shaped part 5, on which a Y-shaped part 6 is also placed near the centre of the bar-shaped part 5. The bar-shaped part 5 is at right angles to the plane through the Y-shaped part 6. The one end of the bar-shaped part 5 of the spacer element 4 is provided with a projection 12 in line with the bar-shaped part 5 and the other end of the bar-shaped part 5 is provided with a recess 13 so that the projection of the one spacer element can interact with the recess which is provided in the other end of the bar-shaped part of a spacer element 14 placed against it.

Figure 6:
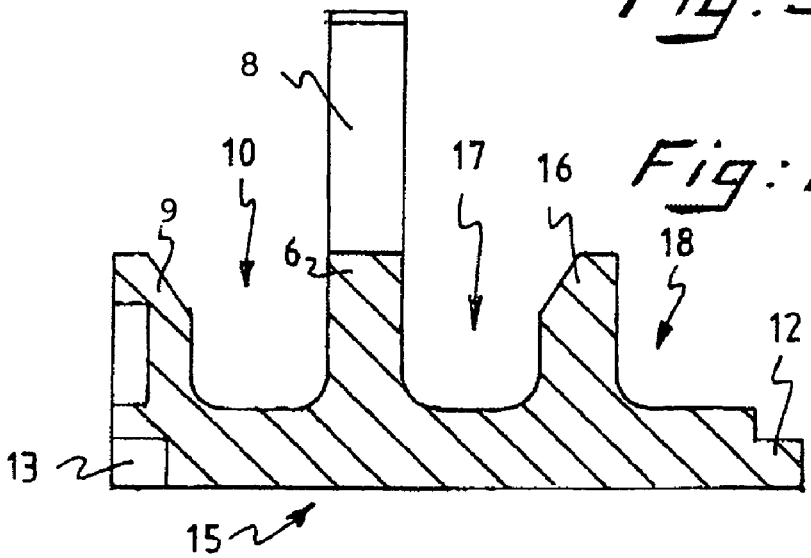
FIG. 6 shows a cross section of another possible embodiment of a spacer element according to the invention.

FIG. 6 shows another possible embodiment of a spacer element 15 according to the invention. Near one end, the bar-shaped part 5 is provided with a transverse part 9 which is at right angles to the bar-shaped part 5 and runs parallel to the Y-shaped part 6, thus creating a U-shaped recess 10 which can accommodate the heating wire 2.

A transverse part 16 is also arranged on the other side of the Y-shaped part 6 and the bar-shaped part 5, as a result of which a U-shaped recess 17 is created on the other side of the Y-shaped part as well, which can also accommodate the heating wire. On the other side of the transverse part 16, an L-shaped recess 18 is created, which can also accommodate the heating wire 2. Both the dimensions of the space delimited on one side by the ceramic bar 3 and on the other side by the U-shaped recesses 10, 17 of a spacer element 4, and the dimensions of the space delimited on one side by the ceramic bar 3 and on the other side by the L-shaped recess 18 of the spacer element 15 and the transverse part 9 of the adjoining spacer element 15 are chosen such that a heating wire or incandescent wire 2 has sufficient space to be able to thermally expand. The one end of the bar-shaped part 5 of the spacer element 4 is provided with a projection 12 in line with the bar-shaped part 5, and a recess 13 is provided in the other end of the bar-shaped part 5, so that the projection of the one spacer element can interact with the recess which is provided in the other end of the bar-shaped part of the spacer element placed against it.

The invention claimed is:

1. Device for keeping a heating wire in position in a horizontal oven, the device comprising:

a bar and a number of spacer elements, each spacer element consisting of a bar-shaped part, on which a Y-shaped part is placed near the centre of the bar-shaped part, the plane through the Y-shaped part being at right angles to the axial direction of the bar-shaped part, wherein a V-shaped part of the Y-shaped part can partially enclose the bar, wherein the bar-shaped part, near one of its axial ends, is provided with an upstanding transverse part which runs parallel to at the one side of the Y-shaped part, creating a U-shaped recess in which the heating wire can be accommodated, wherein the other side of the Y-shaped part and the adjacent portion of bar-shaped part together form an L-shaped recess in which the heating wire can also be accommodated, and wherein the spacer elements are made of ceramic material.

2. Device according to claim 1, wherein one end of the bar-shaped part of the spacer element is provided with a projection in line with the bar-shaped part and a recess is provided in a second opposed end of the bar-shaped part, so that the projection of the bar-shaped part of a first spacer element can interact with the recess of the bar-shaped part of a second spacer element when the first spacer element is placed against the second spacer element.

3. Device according to claim 1, wherein the length of the transverse part corresponds to a length of a stem of the Y-shaped part.

4. Device according to claim 1, wherein the V-shaped part of the Y-shaped part has an O-shaped opening so that the V-shaped part can partially enclose the bar.

5. Device according to claim 1, wherein the bar is cylindrical.

6. Device according to claim 1, wherein the bar is hollow.

* * * * *